United States Patent [19]

Allenbaugh, Jr.

[11] 4,176,794

[45] Dec. 4, 1979

[54] LIQUID PARTICLE DEFLECTOR STRUCTURE FOR DISCHARGE NOZZLES

[75] Inventor: George G. Allenbaugh, Jr., Wadsworth, Ohio

[73] Assignee: Premier Industrial Corporation, Cleveland, Ohio

[21] Appl. No.: 846,146

[22] Filed: Oct. 27, 1977

[51] Int. Cl.[2] ..... B05B 1/12

[52] U.S. Cl. ..... 239/498; 239/458; 239/500

[58] Field of Search ..... 239/456, 458, 460, 498, 239/500

[56] References Cited

U.S. PATENT DOCUMENTS 3,163,363 12/1964 Travis ..... 239/458

FOREIGN PATENT DOCUMENTS 9985 of 1910 United Kingdom ..... 239/498

1379205 1/1975 United Kingdom ..... 239/456

*Primary Examiner*—Robert W. Saifer

*Attorney, Agent, or Firm*—Isler and Ornstein

[57] ABSTRACT

A plurality of circumferentially spaced teeth are positioned in a predetermined manner on the end of a pattern-forming sleeve for a liquid discharge nozzle. Each of the teeth is provided with a stream-deflecting surface which is disposed to deflect portions of the discharge stream angularly into intercepting relationship with each other to increase the liquid particle breakup in the stream and improve the uniformity and homogeneity of the stream pattern.

5 Claims, 8 Drawing Figures

LIQUID PARTICLE DEFLECTOR STRUCTURE FOR DISCHARGE NOZZLES

BACKGROUND OF THE INVENTION

This application relates to liquid flow discharge nozzles, particularly of the type used in fire fighting. It is commonplace for such fire fighting nozzles to have some form of discharge stream pattern adjustment which will permit the discharge to be varied from a straight stream to a mist or wide fog pattern by means of a longitudinally adjustable pattern sleeve which projects beyond the discharge orifice of the nozzle into the path of the stream. The pattern forming sleeve is usually metal and has molded thereto a rubber bumper which serves both to protect the discharge end of the nozzle against damage or injury, as well as to provide a grooved or toothed surface for reflecting a portion of the discharge stream inwardly toward the center of the stream. Examples of this general type of stream-forming pattern sleeve structure are disclosed in U.S. Pat. Nos. 3,387,791; 3,540,657 and 3,784,113.

As the pattern sleeve on the nozzle is adjusted from the straight stream position to the wider fog pattern, a progressively increasing portion of the discharge stream is directed toward the teeth on the bumper. The forward or inwardly directed surfaces of these teeth are flat and are deliberately designed to reflect those portions of the stream which impinge upon it directly back into the central portion of the discharge stream.

The teeth are circumferentially spaced from each other and the non-reflected portion of the stream passes divergently upwardly of the nozzle through the passageways or spaces between the teeth.

By reason of the customary structure of fire-fighting nozzles, which include a central baffle head arrangement, the center portion of the discharge stream contains far fewer water particles than the other portions of the discharge stream. This center portion defines a low pressure area resulting from the jet stream or aspirator effect of the high velocity flow of liquid surrounding it. This central hollow core of the discharge stream is undesirable both from the standpoint of the safety of the hose handler as well as from the standpoint of effectively and efficiently extinguishing a fire.

The purpose of providing the reflecting surfaces on the bumper teeth is to attempt to get some of the water to bounce back into the central void in the discharge stream and thereby increase the water content in this hollow core of the stream. However, the major portion of the discharge stream passes between the spaced teeth and forms the "fingers" of a typical cone pattern. Only a minor proportion of the stream actually is reflected back by the fingers into the hollow central core.

SUMMARY OF THE INVENTION

It has been observed that the low pressure area in the center of the discharge stream causes a rush of air at the higher atmospheric pressure to pass into and through the discharge stream toward the central portion of the stream in order to achieve atmospheric pressure equilibrium. This air flow can be utilized to direct a significantly increased proportion of the stream back toward its hollow center, than is possible by simple utilization of a flat reflecting surface on the teeth of the pattern sleeve.

It is a primary object of the invention to provide an improved form of stream deflecting teeth on the discharge end of a streamforming pattern sleeve for a nozzle.

A further object of the invention is to provide a tooth arrangement of the character described which will result in enhanced atomization or break-up of the liquid particles of the stream which impinge upon the teeth.

Another object of the invention is to improve the uniformity and homogeneity of the discharge stream cross-section.

Other objects and advantages of the invention will appear during the course of the following description and with reference to the annexed drawings in which like parts are designated by like numerals throughout the same.

DESCRIPTION OF THE PREFERRED EMBODIMENTS

Figure 1:
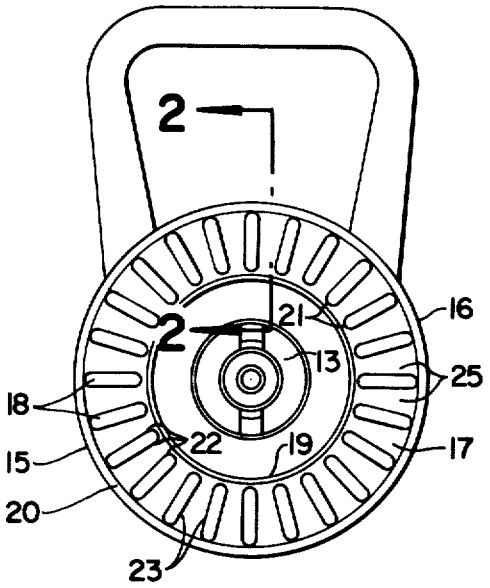
FIG. 1 is a plan view of the end of a pattern sleeve on a liquid discharge nozzle, showing the tooth structure of the invention.
Figure 2:
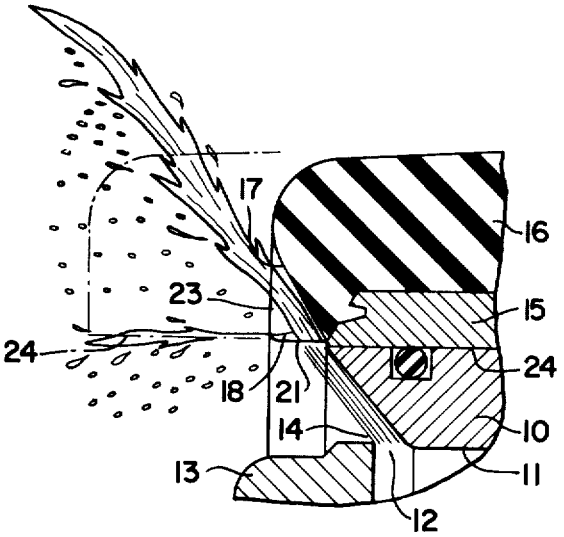
FIG. 2 is an enlarged fragmentary cross-sectional view, taken as indicated on line 2—2 of FIG. 1.

Referring to FIGS. 1 and 2 of the drawing, the parts of a liquid discharge nozzle pertinent to an understanding of the invention are shown. A nozzle body 10 has a throat portion 11 defining a liquid discharge opening 12. Overlying the discharge opening and throat is a baffle 13 which customarily is movably mounted to adjustably define a discharge orifice 14.

Movably mounted on the nozzle body 10 is a streamforming pattern sleeve 15 whose position can be longitudinally adjusted from the phantom line position shown in FIG. 2, for a straight stream pattern, to the solid line position shown in FIG. 1, for a wide fog or spray pattern. The pattern sleeve is usually metal and has customarily molded thereon a protective rubber bumper portion 16. Although the stream-deflecting tooth arrangement hereinafter described is indicated as being provided on the bumper 16, it will be understood that it can be provided on the pattern sleeve regardless of whether the pattern sleeve is a composite of metal and rubber or not.

The terminal portion of the pattern sleeve 15 is provided with an angularly extending tooth-supporting surface 17, which forms part of the bumper 16. A plurality of upright circumferentially-spaced teeth 18 project from the surface 17, adjacent the inner edge 19 thereof, and extend radially outwardly toward the periphery or rim 20 of the surface 17.

The nose or forward portion 21 of each of the teeth 18 has a rounded or arcuate configuration which provides a stream-deflecting surface 22. The sides 23 of each tooth 18 are flat or planar and are substantially parallel with each other. The sides 23 of adjacent teeth 18 define a flow channel for the stream of liquid. The flat sides 23 also serve as impingement surfaces for liquid particle break-up in the manner hereinafter described.

Figure 5:
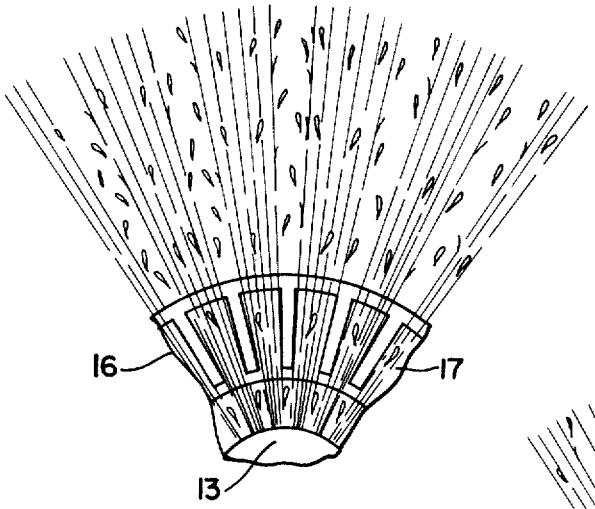
FIG. 5 PRIOR ART
FIGS. 5, 6 and 7 are fragmentary schematic plan views illustrating comparative water stream formations for various tooth arrangements.

As the pattern sleeve is adjustably moved from the phantom line straight stream position toward the wide fog solid line position, progressively greater portions of the discharge stream are directed from the discharge orifice 14 toward the terminal end of the pattern sleeve and the teeth 18 to form a cone spray pattern. The baffle 13 obstructs the center of the discharge opening and tends to create a liquid void in the center of the stream. This void is undesirable from the standpoint of operator safety as well as from the standpoint of fire-fighting efficiency. It has heretofore been accepted that the function of the teeth on the end of the pattern sleeve 15 is to mechanically obstruct the divergence of a portion of the liquid stream when the position of the pattern sleeve is such as to cause the stream to be directed in a cone shaped pattern. As indicated in FIG. 5 of the drawing, the prior art teeth are provided with a nose or forward portion which is flat and substantially parallel to the longitudinal axis of the nozzle. Those portions of the stream whose flow is obstructed by the teeth, are reflected or bounced back into a straight stream trajectory, and the remainder of the stream discharges through the channels formed between adjacent teeth and creates the characteristic "finger" effect in the conical stream pattern. For any given particle of the liquid, there is only a single instance of impingement on the flat nose surface of the tooth.

In contrast to the accepted prior art approach described above, the present invention is based upon utilizing a tooth structure which will not completely obstruct and reflect a portion of the liquid stream, but which will create smaller liquid particles through deflection and multiple impingement of portions of the liquid stream with each other and with the surfaces of the teeth 18. Instead of mechanically deflecting these portions of the liquid stream into a given straight stream pattern, the liquid particles are broken up into sufficiently small particle sizes so that they can be carried by air flow back toward the center of the stream in a dispersed fashion which provides greater uniformity and homogeneity for the stream pattern.

The high pressure and high velocity discharge of water from a fire nozzle creates a low pressure area in the central portion of the discharged stream which generates a substantial air flow toward the center of the stream to achieve atmospheric pressure equilibrium. This atmospheric air flow is of sufficient intensity and velocity to carry with it substantial quantities of fine water particles and direct them toward the center of the discharge stream. The function of the teeth 18 is to break up the liquid particles into a sufficiently fine size so that a substantial portion of the deflected stream will be carried back by the air flow into the desired central area of the cone pattern.

Figure 6:
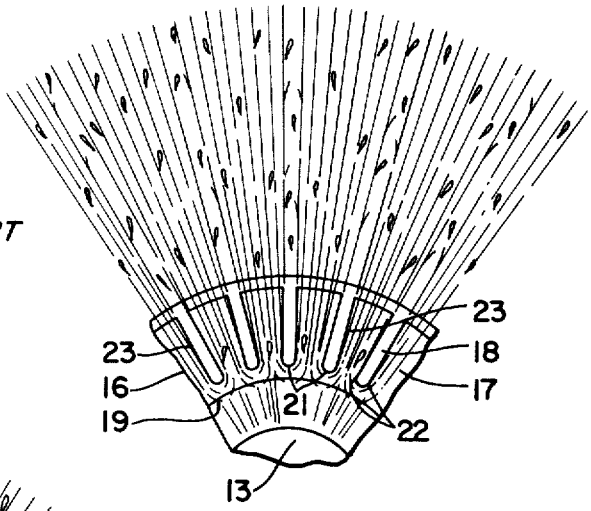

Whereas the flat reflecting forward portion of the prior art form of tooth acts essentially as an extension of the straight stream forming surface 24 of the pattern sleeve 15, the nose portion 21 of the tooth 18 is disposed to deflect the liquid stream angularly in the direction of the adjacent teeth 18 so that these deflected portions of the stream intercept each other to cause further break-up of the liquid particles. The intercepting portions of the deflected stream divert each other into impingement on the sides 23 of the teeth 18 for further particle break-up of the liquid by said impingement, as well as by the interaction of these deflected portions of the stream with the portions of the stream which pass directly into the previously described channels 25 formed between adjacent teeth. Thus the deflected stream is exposed to a multiple sequence of liquid particle atomization which reduces particle size sufficiently so that the inrushing atmospheric air flow can carry the particles toward the center of the discharge stream and restore greater liquid content in this area of the stream pattern. As schematically illustrated in FIG. 6, the resulting conical stream pattern shows a substantial minimization of the undesirable and characteristic "fingers" created by deliberate obstruction of fluid flow by the prior art form of teeth shown in FIG. 5.

Figure 3:
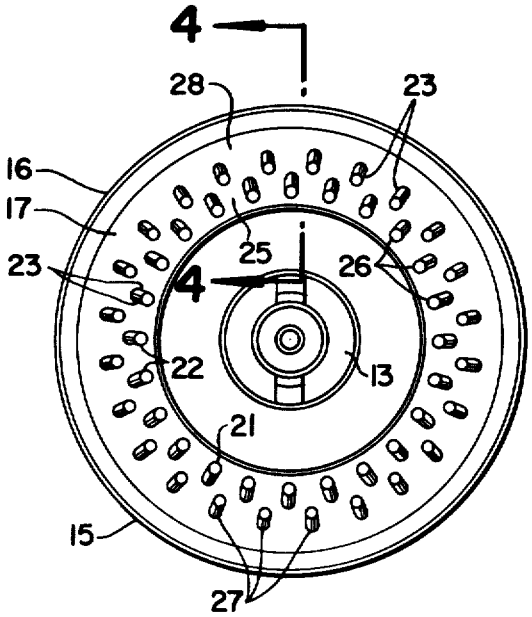
FIG. 3 is a view similar to FIG. 1, but showing another form of the invention.
Figure 4:
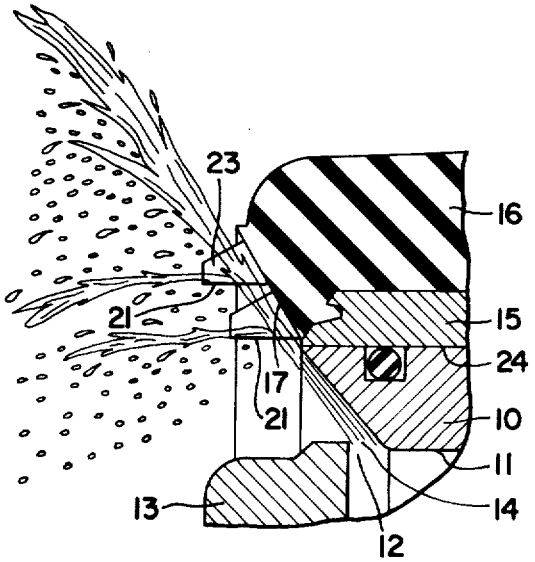
FIG. 4 is an enlarged fragmentary cross-sectional view, taken as indicated on line 4—4 of FIG. 3.

In FIGS. 3 and 4 of the drawing, there is shown a modified form of tooth arrangement on the tooth support surface 17 of the pattern sleeve 15. An inner or first row of circumferentially spaced teeth 26 and a second outer row of circumferentially spaced teeth 27, in staggered relationship to the teeth 26, is utilized.

Both the teeth 26 and the teeth 27 have the rounded stream-deflecting surface 22 on the forward portion 21 thereof. Both the teeth 26 and 27 have the flat side portions 23 as in the previously described tooth 18.

The teeth 27 of the outer row are staggered in relationship to the teeth 26 of the inner row and are preferably disposed midway in the channel 25 formed by the adjacent teeth of the inner row. The teeth 27 are elevated above the teeth 26 so as to project outwardly from the surface 17 to a greater extent than the teeth 26. It has been found desirable, though not mandatory, that the teeth 27 be of somewhat smaller dimension than the teeth 26, particularly in width. The teeth are disposed coaxially relatively to the longitudinal axis of the pattern sleeve 15 and the discharge stream.

The utilization of the staggered outer row of teeth 27 provides an additional deflecting and impingement surface for the discharge stream and provides a discharge channel 28 between adjacent teeth 27 in the outer row. In the larger sizes of fire-fighting nozzles, where the discharge gallonage is of substantial magnitude, the outer row of teeth provides further atomization and particle break-up of the discharge stream to create the necessary fine particle size which will lend itself to being carried back toward the center of the stream by the jet stream or suction effect previously described.

Figure 7:
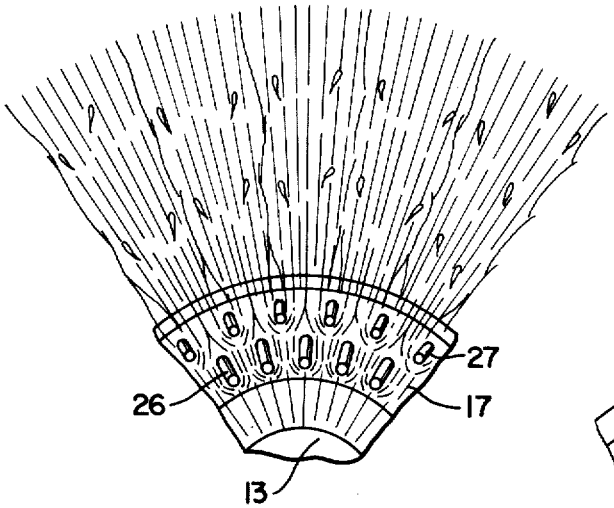

As illustrated in FIG. 7 of the drawing, the disposition of the deflecting teeth in staggered coaxial rows results in substantial elimination of the non-homogeneous pattern of characteristic "fingers" in the wide fog stream and provides a uniformity of stream pattern and liquid content.

Figure 8:
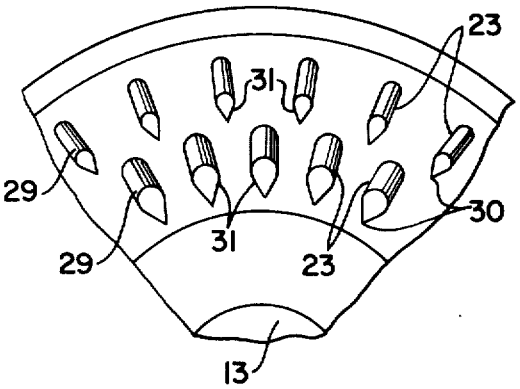
FIG. 8 is a fragmentary plan view, similar to FIG. 3, but showing a modified form of tooth.

In FIG. 8, there is shown a modified form of tooth 29 having a triangular nose portion 30 which presents divergent flat deflecting surfaces 31 to the liquid stream. As in the case of the rounded stream deflecting surfaces 22 of the teeth 18, 26 and 27, the angularly directed deflecting surfaces 31 cause portions of the discharge stream to be directed into intercepting relationship with each other and to be diverted into impingement with the flat sides 23 of the teeth.

As in the case of the previously described rounded stream-deflecting surface 22, the function of the deflecting surfaces 31 is to direct portions of the discharge stream into paths which will cause sufficient atomization of the liquid particles to permit the atmospheric air flow to carry them back toward the center of the discharge stream.

It is to be understood that the forms of my invention, herewith shown and described, are to be taken as preferred examples of the same, and that various changes in the shape, size and arrangement of parts may be resorted to, without departing from the spirit of my invention, or the scope of the subjoined claims.

Having thus described my invention, I claim:

1. In a stream-forming pattern sleeve for a cylindrical liquid discharge nozzle, the combination of an angularly extending tooth-supporting surface provided on the end of said sleeve, a first row of upright circumferentially-spaced teeth projecting from said surface into the path of the discharge stream, a second row of upright circumferentially-spaced teeth projecting from said surface into the path of the discharge stream and radially outwardly of said first row, the teeth of said second row being of lesser width than the teeth of said first row, a stream-deflecting surface presented by each tooth, said stream-deflecting surface having forward portions thereof disposed to deflect said stream angularly toward adjacent teeth, whereby portions of said discharge stream are directed into intercepting relationship with each other to enhance liquid particle breakup of said stream.

2. A combination as defined in claim 1, wherein said forward portions of said stream-deflecting surface are rounded.

3. A combination as defined in claim 1, wherein said forward portions of said stream-deflecting surface are of triangular configuration.

4. A combination as defined in claim 1, wherein the teeth of said second row are circumferentially disposed midway between the teeth of said first row.

5. A combination as defined in claim 1, wherein the teeth of said second row are elevated above the teeth of said first row.

* * * * *